US005515825A

United States Patent [19]

Arai et al.

[11] Patent Number: 5,515,825

[45] Date of Patent: May 14, 1996

[54] CONTROL MECHANISM FOR ENGINE THROTTLE AND CHOKE VALVES

[75] Inventors: Hideto Arai; Takio Ogasawara, both of Hamamatsu, Japan

[73] Assignee: Sanshin Kogyo Kabushiki Kaisha, Shizuoka, Japan

[21] Appl. No.: 422,039

[22] Filed: Apr. 14, 1995

[30] Foreign Application Priority Data

Apr. 15, 1994 [JP] Japan ..... 6-101923

[51] Int. Cl.[6] ..... F02P 5/02; F02N 15/00

[52] U.S. Cl. ..... 123/413; 123/179.18; 261/52

[58] Field of Search ..... 123/400, 413, 123/179.18; 261/52, 64.6

[56] References Cited

U.S. PATENT DOCUMENTS

| | | | |
|---|---|---|---|
| 3,749,069 | 7/1973 | Reese | 123/179.18 |
| 3,859,974 | 1/1975 | Ross | 123/179.18 |
| 3,907,945 | 9/1975 | Kobayashi et al. | 261/52 |
| 4,490,309 | 12/1984 | Fujikawa et al. | 123/179.18 |
| 4,492,198 | 1/1985 | Okumura | 123/413 |
| 4,500,478 | 2/1985 | Furukawa et al. | 261/52 |
| 5,076,233 | 12/1991 | Nelson et al. | 123/400 X |

FOREIGN PATENT DOCUMENTS

| | | | |
|---|---|---|---|
| 60-30474 | 2/1985 | Japan | 123/413 |

*Primary Examiner*—Tony M. Argenbright
*Attorney, Agent, or Firm*—Knobbe, Martens, Olson & Bear

[57] ABSTRACT

An engine control mechanism cooperates with both a manual choke operator and a manual throttle operator. The manual throttle operator actuates a throttle control mechanism and a timing advance mechanism. A lost motion connection interconnects the manual throttle operator and the throttle control mechanism. The manual choke operator actuates a choke control mechanism to close the choke valves associated with the engine charge formers. The manual choke also operates the timing advance mechanism and the throttle control mechanism to advance the spark timing and to slightly open the throttle valves beyond an idle position when the choke valves are closed. Operation of the throttle control mechanism via the manual choke operator, however, does not affect the manual throttle operator due to the lost motion connection between the throttle operator and the throttle control mechanism.

23 Claims, 10 Drawing Sheets

CONTROL MECHANISM FOR ENGINE THROTTLE AND CHOKE VALVES

BACKGROUND OF THE INVENTION

1. Field of the Invention

The present .invention relates in general to an internal combustion engine. In particular, the present invention relates to a control mechanism of the engine for controlling the throttle and choke valves of at least one charge former of the engine.

2. Description of Related Art

To start a cold engine, the fuel/air ratio of a fuel charge delivered to the engine should contain a higher concentration of fuel (i.e., be "richer") than under when the engine is running under normal conditions. Conventional carburetors use various types of cold starting devices to produce a richer charge when starting a cold engine. For instance, a choke valve is used in a conventional carburetor to decrease air flow into a mixture chamber of the carburetor, and consequently the concentration of fuel in the charge is increased. With the closure of the choke valve, a corresponding throttle valve of the carburetor also should be at least partially opened to start the engine.

Throttle and choke valves, however, commonly are operated independently of each other, and starting the engine typically involves a complicated procedure. The user initially pulls a choke knob to close the choke valve and partially opens the throttle valve by rotating the hand grip of a conventional throttle control mechanism. The user then pulls a starter rope to start the engine. Once started, the user opens the choke valve by pushing the choke knob back to its initial position.

Users of outboard engines, however, tend to forget to either close the choke valve or open the throttle valve when starting the cold engine. A cold engine generally will not start without performing both steps. Users, thus, often become frustrated when trying to start the engine when they have forgotten to open the throttle or close the choke.

SUMMARY OF THE INVENTION

The present invention includes the recognition that several problems arise if the operation of the choke and throttle valves were directly interlocked. For instance, the loading on the manual choke operator would tend to be increased due to the frictional forces associated with the throttle operator. The choke operator thus would become more difficult to actuate. In the case where the throttle operator includes actuating cables, the choke operator also would drive at least one cable in a manner causing it to buckle which could damage the throttle operator. In addition, directly interlocking the operation of the throttle and choke valves would unnecessarily cause the choke valves to move when the engine is running. The choke valves would close at inappropriate occasions (e.g., at part or full throttle), thereby choking the engine and causing the engine to stall. The present invention thus recognizes the need for a throttle-choke operating mechanism which simultaneously closes the choke and opens the throttle when the choke operator is actuated, but operates the throttle valve independently of the choke valve.

One aspect of the present invention thus involves a control mechanism of an engine for controlling the operation of the choke and throttle valves of at least one charge former. The control mechanism comprises a throttle control mechanism coupled to the throttle valve and operated by a throttle operator. The control mechanism additionally includes a choke control mechanism which is coupled to the choke valve and is operated by a choke operator. The choke operator also is coupled to the throttle control mechanism in a manner opening the throttle valve when closing the choke valve; however, operation of the throttle valve by the choke operator does not affect the throttle operator.

In accordance with another aspect of the present invention, a control mechanism of an engine controls the operation of at least one valve of at least one charge former. The control mechanism comprises a valve control mechanism coupled to the charge former valve. The valve control mechanism is operated by both a first operator and a second operator. A first lost motion connection couples the first operator to the valve control mechanism such that the second operator can operate the valve control mechanism without affecting the first operator. A second lost motion connection couples the second operator to the valve control mechanism such that the first operator operates the valve control mechanism without affecting the second operator.

An additional aspect of the present invention involves a control mechanism of an engine for controlling the operation of a choke valve and a throttle valve of at least one charge former. The control mechanism comprises a choke control mechanism which opens and closes the choke valve. A choke operator actuates the choke control mechanism. The control mechanism also includes a throttle control mechanism having a throttle control plate which is coupled to the throttle valve to open and close the throttle valve. A throttle operator actuates the throttle control mechanism to move the throttle control mechanism between an idle position and a wide open position. The throttle control mechanism is biased toward the idle position. A rod extends between the choke control mechanism and the throttle control mechanism. The rod unilaterally transmits movement of the choke operator to the throttle control mechanism. The throttle control plate and the throttle operator have engaging structures which engage when the throttle operator is moved such that the throttle control mechanism responds to movement of the throttle operator. The engaging structures, however, disengages when the rod moves the throttle control mechanism so that the throttle operator is not affected by the rod's movement.

BRIEF DESCRIPTION OF THE DRAWINGS

These and other features of the invention will now be described with reference to the drawings of a preferred embodiment which is intended to illustrate and not to limit the invention, and in which.

DETAILED DESCRIPTION OF A PREFERRED EMBODIMENT

Figure 1:
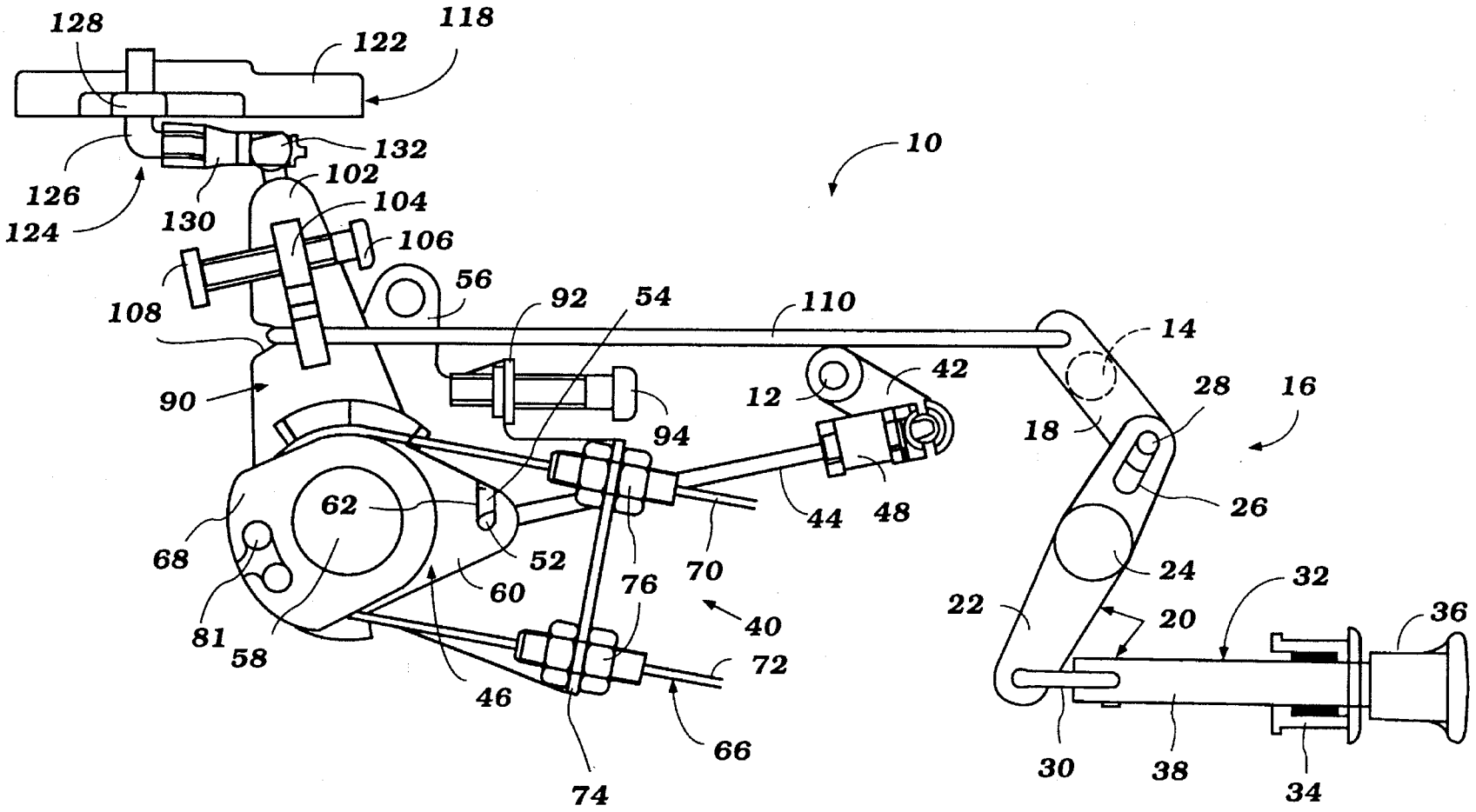
FIG. 1 is a side elevational view of a control mechanism for operating throttle and choke valves of an engine, the control mechanism being configured in accordance with a preferred embodiment of the present invention and illustrated in an idle position.

FIG. 1 illustrates a control mechanism 10 for controlling the choke and throttle valves of an engine, the control mechanism 10 being configured in accordance with a preferred embodiment of the present invention. Though it is understood that the present control mechanism 10 can be incorporated into any type of internal combustion engine, the present invention is particularly well suited for application in conjunction with a vertically oriented engine of a marine outboard motor. It is contemplated, however, that certain aspects of the present invention can be employed with an inboard/outboard motor equally as well.

The present control mechanism 10 desirably operates a vertical series of charge formers, e.g., carburetors (not shown) . The carburetors may be of any known type and construction; however, each carburetor desirably is provided with a choke valve and a throttle valve to regulate the mixture of fuel and air to at least one cylinder of the engine, as known in the art. A choke shaft desirably supports each choke valve over a throat of the carburetor and controls the opening degree of the choke valve, as known in the art. In the illustrated embodiment, the choke valve desirably is an offset butterfly-type valve, and rotation of the choke shaft moves the choke valve between a closed position and a full open position. The choke shaft thus controls the angle of the choke valve relative to its closed position. Although the present control mechanism is described in connection with a butterfly- type valve, it should be understood that the present invention can be used equally well with other types of choke valves, such as, for example, slider type valves° In addition, although the illustrated control mechanism 10 is configured to operate the choke valves of carburetors, other aspects of the present invention also lend themselves to applications involving other types of cold starting devices used with other types of charge formers, such as, for example, fuel injectors.

Each carburetor also includes a throttle shaft which supports the throttle valve within the throat of the carburetor. Like the choke valve, the throttle valve desirably is an off-set butterfly-type valve, but it is understood that other types of valves, such as slider valves, can be used with the present control mechanism 10 equally as well. Rotation of the throttle shaft controls the orientation of the throttle valve within the carburetor throat, as known in the art.

For ease of description, the present control mechanism 10 will be described in terms of its orientation shown on the accompanying figures. Because these figures illustrate an exemplary embodiment of the present control mechanism 10 and are not meant to limit the present invention in any way, it should be understood that the orientation and arrangement of the present control mechanism 10 can be readily adapted by those skilled in the art to suit a particular engine configuration. Thus, description terms such as, for example, "top," "bottom," "left," "right," "clockwise," and "counter-clockwise" should not be construed as limiting the structure or operation of the present control mechanism 10.

In the illustrated embodiment of FIG. 1, the control mechanism 10 operates a throttle control shaft 12 and a choke control shaft 14. The throttle control shaft 12 either can directly operate a dedicated throttle valve or can operate a throttle linkage system which interconnects a plurality of throttle shafts. That is, the throttle control shaft 12 may directly operate a corresponding throttle valve (i.e., can function as a throttle shaft) and be coupled to the other similar throttle valve shafts by a suitable linkage known in the art. In the alternative, the throttle control shaft 12 can be a link which connects the present control mechanism 10 to a known throttle actuating cam mechanism.

Likewise, the choke control shaft 14 can operate one or more choke valves. The choke control shaft 14 either can be a choke valve shaft which operates a corresponding choke valve and is coupled to the other choke valve shafts by a suitable linkage known in the art, or, in the alternative, can be a link to a known choke actuation mechanism.

As illustrated in FIG. 1, a choke control mechanism 16 operates the choke control shaft 14. For this purpose, a choke control lever 18 of the choke control mechanism 16 is attached to the choke control shaft 14. The choke control lever 18 desirably extends to either side of the choke control shaft 14.

An actuator linkage 20 is attached to a lower end of the choke control lever 18. The actuator linkage 20 includes an actuating lever 22 which pivots about a shaft 24. An upper end of the lever 22 includes a slot 26. The slot 26 receives a pin 28 which extends from a lower end of the choke control lever 18. The slot 26 has a sufficient length to allow the choke control shaft 14 to rotate from a closed position in which each choke valve closes the corresponding carburetor throat to an open position in which the choke valve is fully open. The interconnection between the pin 28 and the slot 26 couples the actuator lever 22 and choke control lever 18 together while allowing the levers 18, 22 to rotate across each other.

A link 30 of the actuator linkage 20 connects the lower end of the actuator lever 22 to a manual choke operator 32 which operates the choke control mechanism 16. In the illustrated embodiment of FIG. 1, the manual choke operator moves relative to a fixed grommet 34. The grommet 34 is connected to a cowling (not shown) which commonly surrounds the marine engine and supports the manual choke operator 32. The choke operator 32 includes a knob 36 which desirably is positioned outside the cowling and a shank 38 which extends through the grommet 34 and into the cowling.

The link 30 of the actuator linkage 20 connects to the end of the shank 38 opposite the choke knob 36. The shank 38 slides through the grommet 34 as a user pulls or depresses the choke knob 36 to operate the choke control mechanism 16, as described below. In this manner, the user can operate the choke operator 32 without opening the cowling.

As seen in FIG. 1, a throttle control mechanism 40 operates the throttle control shaft 12. For this purpose, a throttle control lever 42 of the throttle control mechanism 40 is attached to the throttle control shaft 12. The throttle control lever 42 has a conventional shape and is attached to the throttle control shaft 12 at one end by known means.

Figure 2:
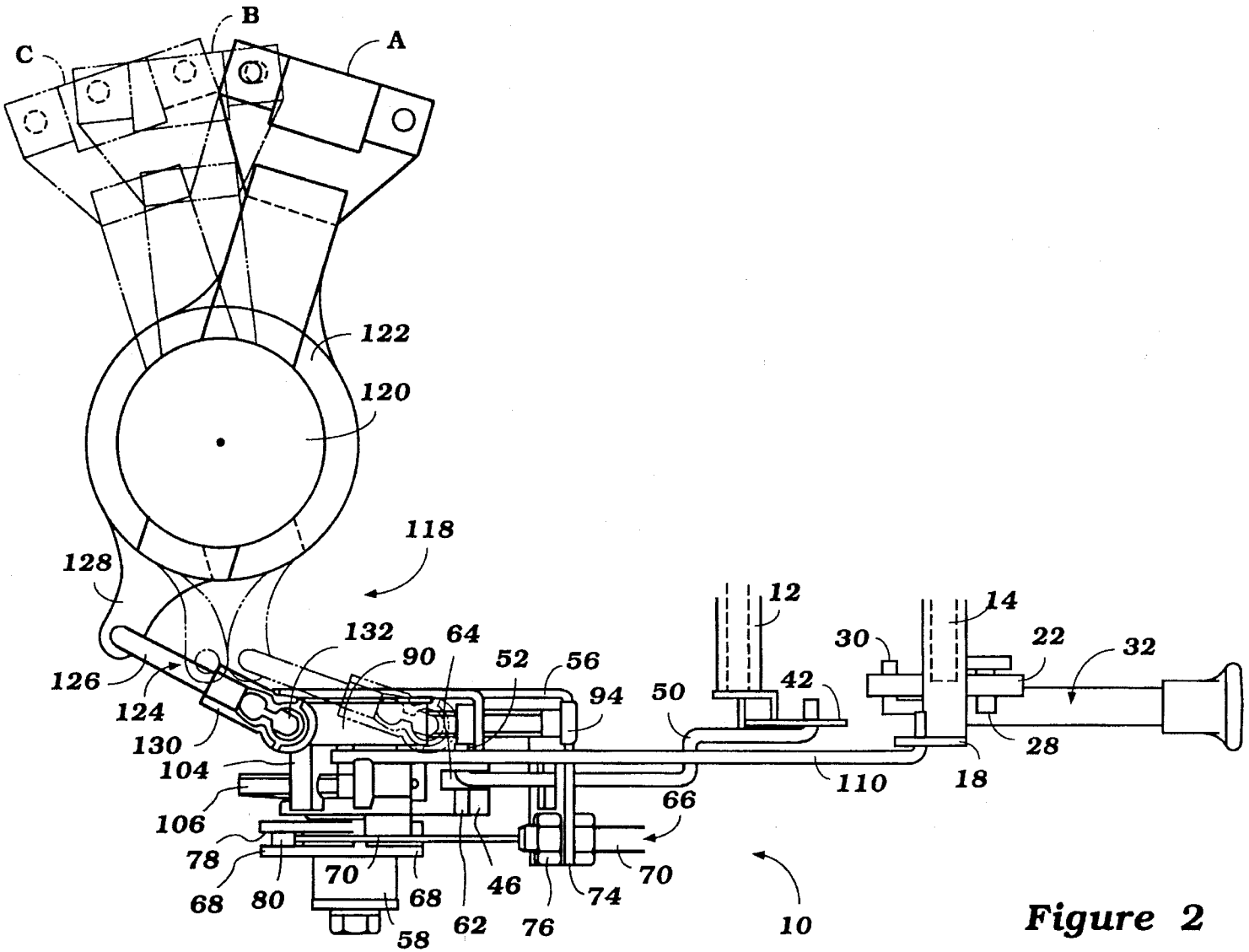
FIG. 2 is a top plan view of the control mechanism of FIG. 1.

A linkage rod 44 connects the throttle valve lever 42 to a throttle control plate 46. A conventional clip 48 connects one end of the linkage rod 44 to a lower end of the throttle control lever 42. In the illustrated embodiment, as seen in FIG. 2, the linkage rod 44 includes a transition section 50 that allows the throttle control lever 42 and throttle control plate 46 to lie on different planes. The opposite end of the linkage rod 44 includes a bent end 52 which engages an aperture 54 (FIG. 1) in the throttle control plate 46, as described below.

With reference to FIG. 1, the throttle control plate 46 rotates over support plate 56 which is attached to the engine. In the illustrated embodiment, the throttle control plate 56 rotates about a pivot shaft 58 which extends from the support plate 56.

The throttle control plate 46 includes an arm 60 which is connected to the end of the linkage rod 44. The aperture 54 is defined at the end of the arm 60. The aperture 54 is formed by a hole which extends through the plate 46, a first channel 62 which extends from an outer side of the arm 60 to the hole, and a second channel 64 which extends from the end of the arm 60 to the first channel 62 between the two side surfaces of the throttle control plate 46. The bent end 52 of the linkage rod 44 is attached to the throttle plate 46 by inserting the bent end 52 through the hole with an end portion of the linkage rod 44 passing through the first channel 62. With the linkage rod 44 resting on the bottom of the first channel 62, the linkage rod 44 is rotated into the second channel 64. So positioned, the linkage rod 44 is connected to the arm 60 of the throttle control plate 46 in a manner which interconnects the components 44, 46 so as to transmit movement of the throttle plate 46 to the rod 44 yet allow the linkage rod 44 to pivot relative to the control plate arm 60.

The throttle control plate 46 and the linkage rod 44 couples a throttle operator 66 to the throttle lever 42. In the illustrated embodiment, a pulley 68 of the throttle operator 66 is coupled to the throttle plate 46 through a first lost motion connection 69. The specifics of and the purpose for the first lost motion connection 69 will be described below in detail. The pulley 68 rotates about the pivot shaft 58 above the throttle control plate 46 in the illustrated figure.

The throttle operator 66 also includes a pair of Bowden wire cables 70, 72 which extend between the pulley 68 and a conventional manual operator (not shown), which typically is located on a steering handle of the outboard motor or is remotely located proximate to the steering controls of the watercraft. In the illustrated embodiment, the wire cables 70, 72 generally extend parallel to each other.

A support bracket 74 which extends from the support plate 56 supports each wire cable 70, 72. Conventional fittings 76 journal the wire cables 70, 72 through the support bracket 74. The support bracket 74 holds the wire cables 70, 72 apart at a distance which generally corresponds to the diameter of the pulley 68 and at a position so that the wires 70, 72 lie generally within the same plane as the pulley 68.

As understood from FIGS. 1 and 2, each wire cable 70, 72 partially wraps around the end of the pulley 68 and lies within a groove 78 formed in the rear side of the pulley 68. Each wire cable 70, 72 includes a cylindrical plug 80 at its end. The plug 80 of each wire cable 70, 72 fits into a correspondingly shaped aperture 81 formed at the rear end of the pulley 68 to connect the wire 70, 72 to the pulley 68. In this manner, when the manual throttle operator actuates the first wire cable, the cable 70 pulls on the plug 80 which causes the pulley 68 to rotate. The pulley 68 in turn pulls the second plug 80 and wire 72. Actuation of the second wire cable 72 causes the pulley 68 to rotate in the opposite direction which likewise causes the first plug 80 and wire cable 70 to follow the pulley's movement.

Figure 3B:
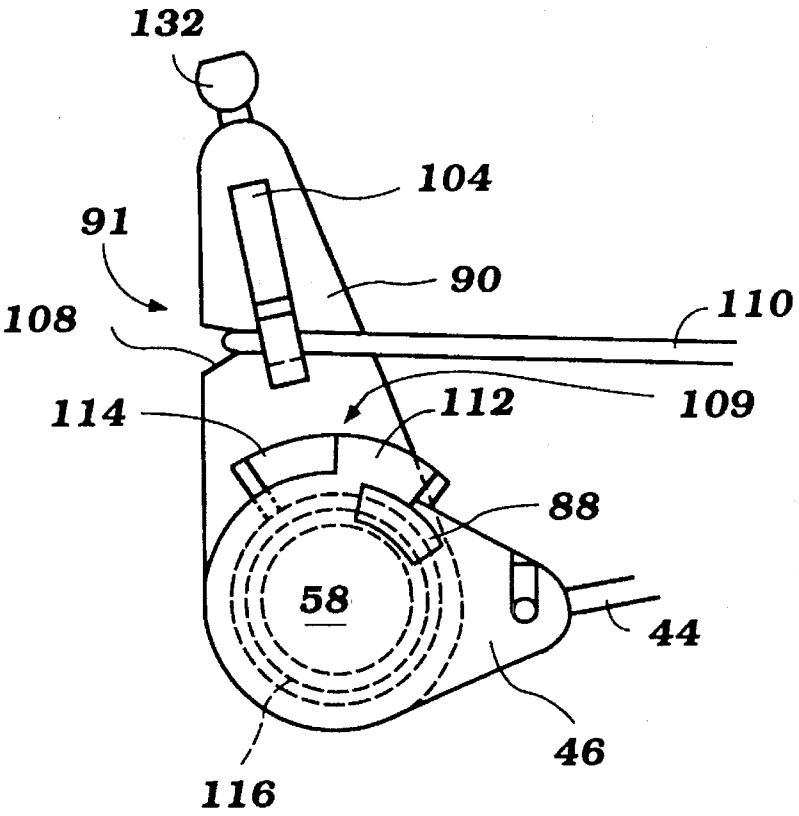
FIG. 3*b* is a side view of a timing control lever of the control mechanism of FIG. 1 in the idle position.
Figure 3A:
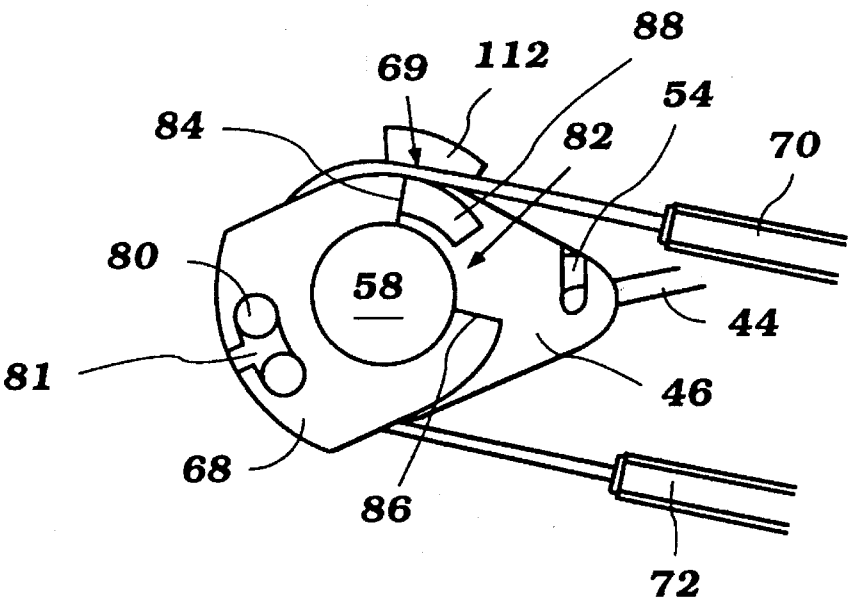
FIG. 3*a* is a side view of a throttle control mechanism of the control mechanism of FIG. 1 in the idle position.

FIG. 3 best illustrates the lost motion connection between the pulley 68 and the throttle control plate 46. In this figure, the pulley 68 is shown in cross-section to expose an undercut section 82. The undercut section 82 extends between a first face 84 and a second face 86. The throttle control plate 46 includes a lug 88 which projects from the plate 46 to lie within the undercut section 82 between the first and second faces 84, 86. The ends of the lug 88 are shaped to correspond to the first and second faces 84, 86 of the pulley 68. In this manner, the lug 88 abuts the corresponding faces 84, 86 of the pulley 68 when the pulley 68 is rotated into engagement with the throttle control plate 46.

With reference back to FIG. 1, the throttle control plate 46 also cooperates with a timing control lever 90. The timing control lever 90 rotates about and is supported by the pivot shaft 58, and lies between the support plate 56 and the throttle control plate 46. The timing control lever 90 rotates over the support plate 56 between a first position (see FIG. 1) defined by a first adjustable stop and a second position (see FIG. 8) defined by a second adjustable stop. As seen in FIG. 1, the second adjustable stop comprises a bracket 92 attached to the support plate 56 and a spark advance adjust screw 94 threaded through a threaded hole in the bracket 92. The end of the adjust screw 94 limits the travel of the timing control lever 90 in the clockwise direction.

Figure 4:
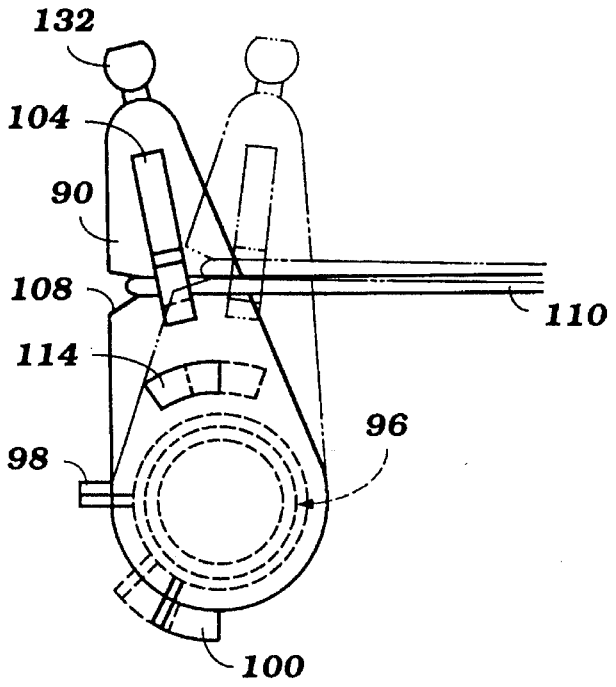
FIG. 4 is a side view the timing control lever of FIG. 1, illustrating movement of the lever between an idle position and a choke position (shown in phantom)

As best understood from FIG. 4, a biasing mechanism biases the timing control lever 90 toward the first position. In the illustrated embodiment, the biasing mechanism is a preloaded helical torsion spring 96 interposed between cooperating lugs 98, 100 on the support plate 56 and the timing control lever 90. As illustrated in FIG. 4, the spring 96 winds as the timing control lever 90 rotates from the first position toward the second position.

With reference to FIG. 1, the timing control lever 90 includes an arm 102 which carries a bracket 104. The bracket 104 defines a threaded hole through which an idle adjust screw 106 is threaded. The screw 106 cooperates with a first stop 108 so as to define the first position of the timing control lever 90.

The timing control lever 90 desirably is coupled to the choke lever 18 through a second lost motion connection 91 such that actuation of the choke control lever 18 to close the choke valve operates the timing control lever 90, but opening the choke valve does not affect the position of the timing control lever 90. That is, the second lost motion connection 91 unilaterally transmits movement of the choke valve to the timing control lever 90 only when closing the choke valve. For this purpose, the timing control lever arm 90 defines a v-shaped notch 108 on a side opposite of the choke lever 18. The bracket 104 also includes an aperture (not shown) which generally aligns with the notch 108 and the upper end of the choke lever 18.

A linkage rod 110 interconnects the choke lever 18-and the timing control lever 90. The linkage rod 110 connects to the choke lever 18 by conventional means. The other end of the rod 110 has a hook-like shape which engages the notch 108 of the timing control lever 90. In the first or idle position illustrated in FIG. 1, the hook end of the linkage rod 110 lies within the notch 108, hooking around the rear side of the timing control lever 90. The linkage rod 110 extends through the aperture in the bracket 104 when assembled. The v-shape of the notch 108 guides the hook end of the rod 110 toward the vertex of the notch 108 to establish the interconnection.

A third lost motion connection 109 also connects the timing control lever 90 to the throttle control plate 46. In the illustrated embodiment, as best seen in FIG. 3*b*, the third lost motion connection 109 comprises a first lug 112 which extends from the side of the throttle control plate 46 and a second lug 114 which extends from the timing control lever 90 toward the throttle control plate 46. The lugs 112, 114 are configured and positioned so as to abut each other when the throttle control plate 46 and the timing control lever 90 travel together, as described below.

The third lost motion connection 109 also includes a biasing mechanism with biases the lugs 112,114 against each other. In the illustrated embodiment, the biasing mechanism is a preloaded helical torsion spring 116. The spring 116 winds as the lugs 112,114 separate from each other. In this manner, the throttle control plate 46 and the timing control lever 90 are biased to rotate together, yet the pulley 68 can continue to rotate the throttle control plate 46 about the support shaft 58 after the timing control lever has reached its second position, as described below. The torsion spring 116 between the throttle control plate 46 and the timing control lever 90 desirably has a greater spring constant than the torsion spring 96 between the timing control lever 90 and the support plate 56.

In addition to interconnecting the throttle control plate 46 and the choke lever 18 through a lost motion connection, the timing control lever 90 also adjusts the spark timing of the engine in response to the position of the throttle valves. That is, as seen in FIGS. 1 and 2, the timing control lever 90 cooperates with a conventional spark triggering and advance mechanism 118 associated with the end of the crankshaft 120 (FIG. 2).

In the illustrated embodiment, as best seen in FIG. 2, the spark triggering and advance mechanism 118 includes a timing plate or table 122 which is journaled in a known manner to rotate relative to the crankshaft 120. The timing table 122 supports a pulser coil (not shown) which is juxtaposed to permanent magnets (not shown) affixed to the crank shaft in a known manner. As known in the art, the number of permanent magnets spaced around the crankshaft 120 corresponds to the number of cylinders of the engine or the number of separate firing pulses demanded by the engine. As well known with this type of timing mechanism, rotation of the magnets generates a potential and a spark will be initiated when the magnets come into proximity with the pulser coil.

The timing control lever 90 alters the spark timing in response to the position of the throttle valves. For this purpose, a linkage 124 connects the upper end of the lever arm 90 to the timing table 122. In the illustrated embodiment, the linkage 124 includes a rod 126 which extends between a first arm 128 of the timing table 122 and the upper end of the timing control lever 90. One end of the rod 126 is attached to the arm 128 of the timing table 122 in a known manner. The opposite end of the rod 126 includes a known socket coupling 130 which engages a ball 132 formed at the end of the timing control lever 90. The socket 130 and ball 132 form a ball joint connection which allows the linkage rod 126 to rotate about the ball 132 of the timing control lever 90, while allowing the timing control lever 90 to rotate about the support shaft (FIG. 1) and relative to the arm 128 of the timing table 122. The general position of the timing table 122 when in the idle position is referenced by the reference letter A and illustrated in solid lines in FIG. 2.

The present control mechanism 10 allows the manual choke operator 32 to actuate the throttle valve and the spark advance mechanism 118, in addition to closing the choke valve, without affecting the manual throttle operator 66. The following elaborates on the operation of the present control mechanism 10.

FIG. 1 illustrates the position of the control mechanism 10 before starting the engine (or when the engine is idling as described below). Under this condition, the choke valve for each charge former is open. The corresponding throttle valve lies in the position established by the idle adjust screw 106 on the timing control lever 90. The idle adjust screw 106 defines the rotational position of the timing control lever 90 on the pivot shaft 58, which in turn establishes the rotational position of the throttle control plate 46 on the pivot shaft 58 through the interaction between the corresponding lugs 98, 100. The position of the throttle control plate 46 defines the position of the throttle control lever 42 which controls the position of the throttle shafts. By adjusting the idle adjust screw 106, the opening degree of throttle valves at idle can be controlled.

Figure 5:
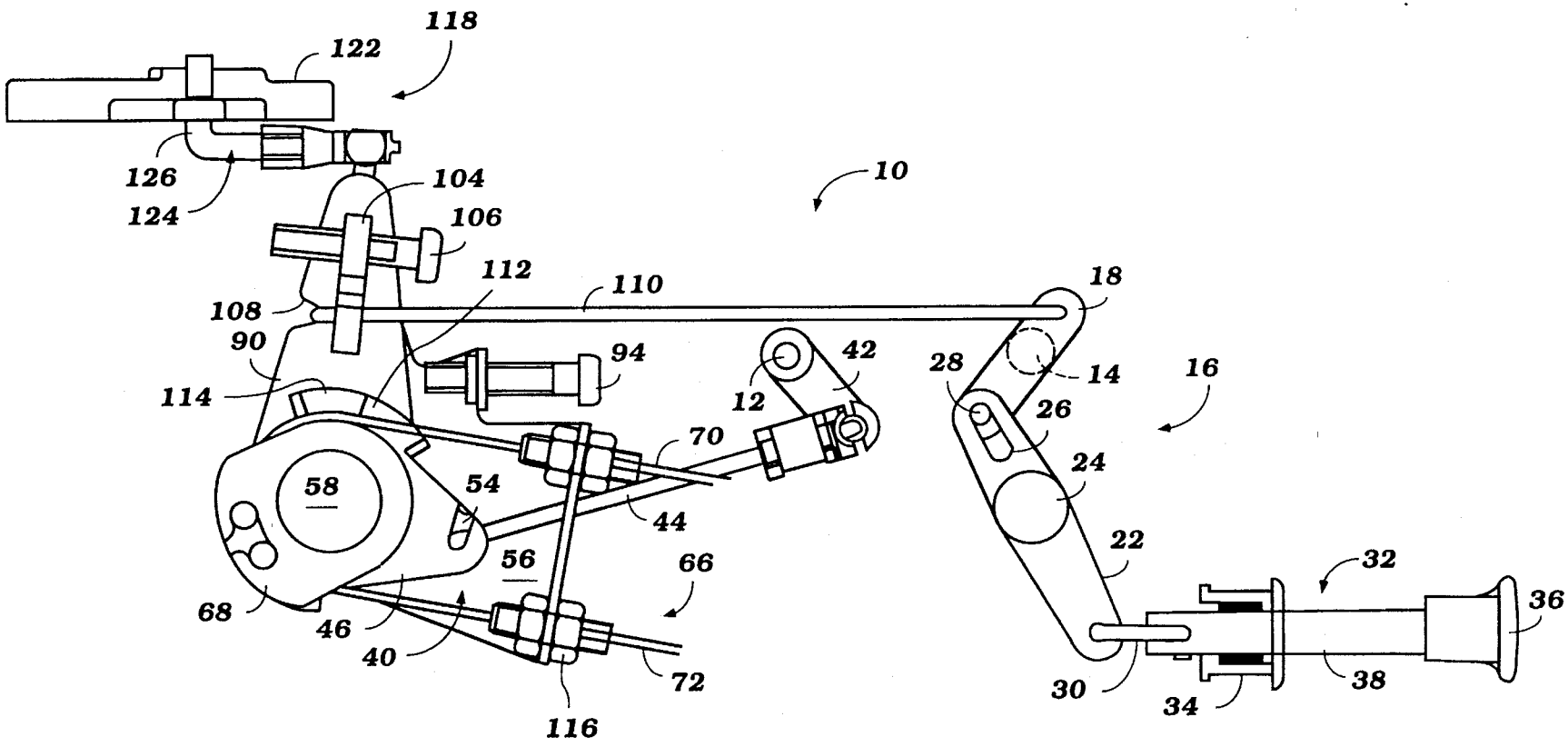
FIG. 5 is a side view of the control mechanism of FIG. 1 illustrated in a choke position.

With reference to FIG. 5, the user actuates the manual choke operator 32 to start the cold engine. In the illustrated embodiment, the choke knob 36 is pulled away from the motor cowling which rotates the actuator lever 22 in the counter-clockwise direction. The connection between the upper end of the actuator lever 22 and the lower end of the choke valve lever 18 rotates the choke valve lever 18 in the clockwise direction to close the choke valve. Through the rotational motion of the choke control lever 18 and the actuator lever 22, the connection pin 28 slides within the slot 26 of the actuator lever 22.

The choke linkage rod 110 also communicates the rotational movement of the choke control lever 18 to the timing control lever 90 which rotates about the pivot shaft 58 in the clockwise direction. The timing control lever 90 moves from the idle position to a position between the idle position and the second position. FIG. 4, illustrates the movement of the timing control lever 90 between the idle position (shown in solid lines) to the intermediate position (shown in phantom lines). As understood from FIG. 4, the spring 96 winds as the timing control lever 90 rotates in the clockwise direction; however, the frictional forces within the manual choke operator 32 overcome the bias of the spring 96 to hold the timing control lever 90 in this established position.

Figure 6A:
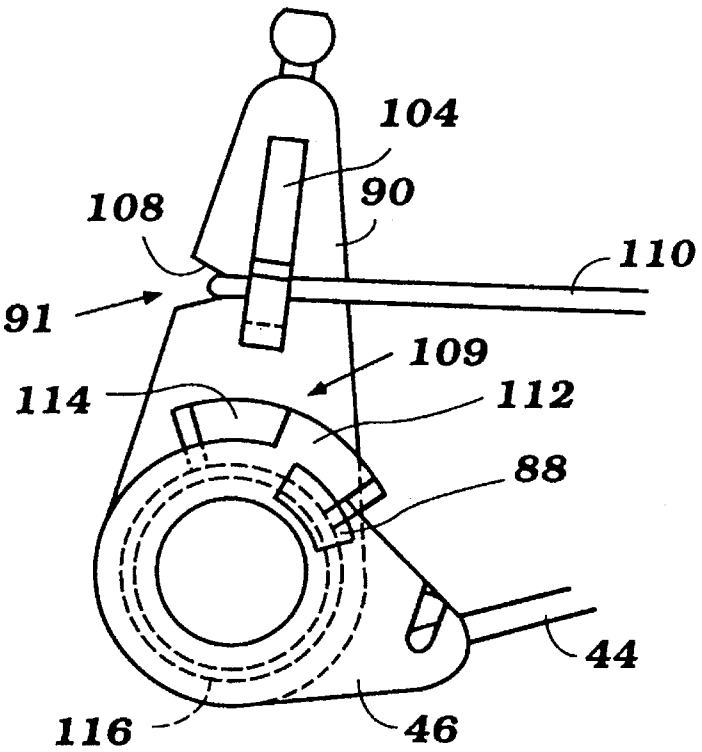
FIG. 6*a* is a side view of the timing control lever of FIG. 3*b* illustrated in the choke position.

As seen in FIGS. 5 and 6*a*, the interengagement between the corresponding lugs 112, 114 of the timing control lever 90 and the throttle control plate 46, which is maintained by the spring 116, causes the throttle control plate 46 to rotate in the clockwise direction with the timing control lever 90. The throttle control plate 46 thus rotates clockwise in the illustrated embodiment as a result of the corresponding movement of the timing control lever 90. The throttle linkage rod 44 communicates this rotational movement to the throttle control lever 42 which causes the corresponding throttle shafts to rotate desirably by a similar degree. In this manner, the corresponding throttle valves open to a desired degree when the choke valve is closed.

Figure 6B:
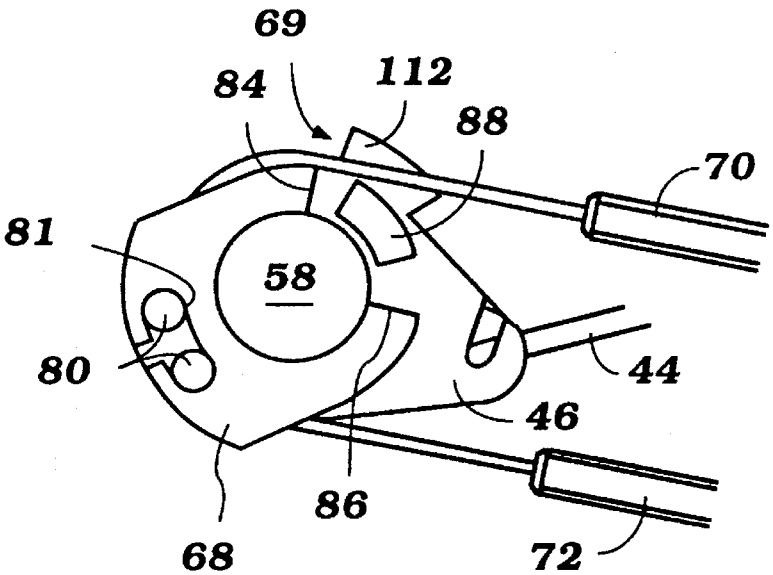
FIG. 6*b* is a side view of the throttle control mechanism of FIG. 3*a* illustrated in the choke position.

As seen in FIG. 6*b*, the rotation of the throttle control plate 46 effected by the timing control lever 90 is not transfer to the pulley 68 of the manual throttle operator 66. The first lost motion connection 69 between the pulley 68 and the throttle control plate 46 permits the throttle control plate 46 to rotate while the pulley 68 remains in the idle position. The lug 88 of the throttle control plate 46 freely rotates into the relief formed between the faces 84, 86 of the undercut section 82 of the pulley 68. In this manner, the throttle control plate 46 moves to open the corresponding throttle valves without moving the manual throttle operator 66.

The timing control lever 90 also operates the spark advance mechanism 118. In the illustrated embodiment, as best understood from FIGS. 2 and 5, the timing control lever 90 pulls the linkage 124 and arm 128 of the timing table 122 toward the throttle shaft lever 42 as it rotates under the force applied by the choke linkage rod 110. As seen in FIG. 2, the timing plate table 122 rotates in the counter-clockwise direction about the crankshaft 120. The general position of the timing table 122 when the choke valve is closed is illustrated in phantom lines and is referenced by the reference letter B. Rotation of the timing table 122 rotates the pulser coil so as to advance the spark timing when starting the engine with the choke valve closed.

Figure 8:
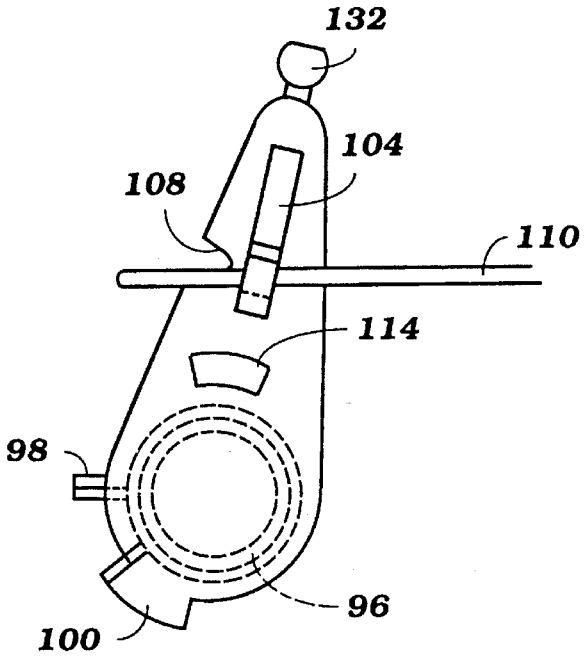
FIG. 8 is a is a side view of the timing control lever of FIG. 7 in the part throttle position with a rod of a choke control mechanism returned to an unactuated position.
Figure 7:
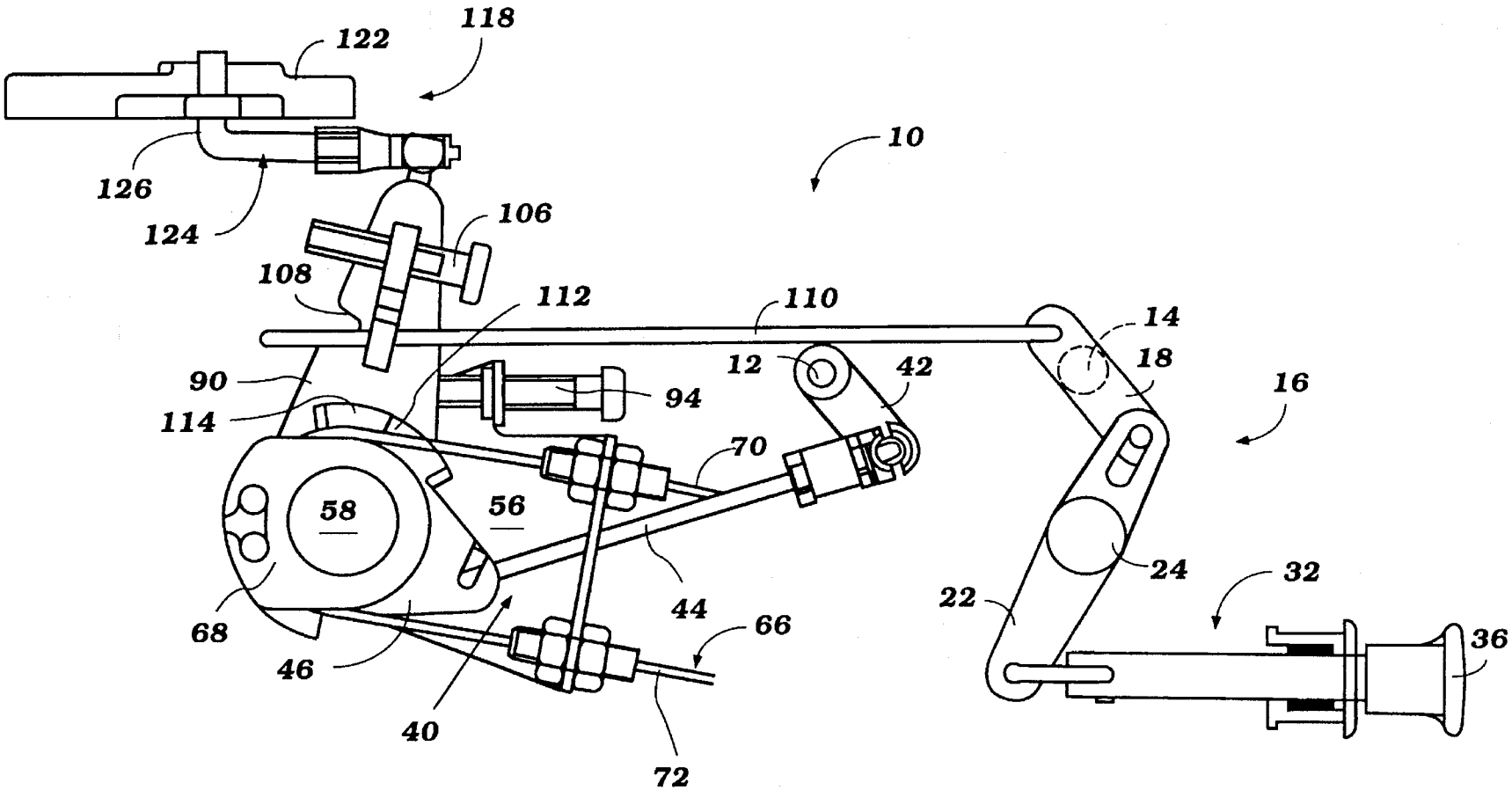
FIG. 7 is a side view of the control mechanism of FIG. 1 illustrated at a part throttle position.

FIGS. 7 through 9 illustrate the position of the control mechanism 10 in a part throttle position with the choke valve open. As seen in FIG. 7, the user pushes the choke knob 36 against the support grommet 34 to open the choke valves. In the illustrated embodiment, this movement rotates the actuator lever 22 in the clockwise direction which moves the choke lever 18 in the counter-clockwise direction. The choke linkage rod 110 moves toward the timing control lever 90 as the choke lever 18 rotates. The linkage rod 110, however, does not move timing control lever 90 due to the lost motion connection 91 between the rod 110 and the timing control lever 90. The hook end of the rod 110 disengages from the lever notch 108 when the choke lever 18 moves the rod 110 toward the timing control lever 90. With the choke valve opened and the control mechanism 10 at part throttle, the choke control mechanism 16 is decoupled from the spark adjust mechanism 118 and the throttle control mechanism 40, as seen in FIGS. 7 and 8. The bracket 104 of the lever 90 supports the hook end of the linkage rod 110 when the hook end does not engage the lever notch 108.

Under the part throttle condition illustrated in FIG. 7, the manual throttle operator 66 rotates the pulley 68 in the clockwise direction via the bowden wire cables 70, 72, as known in the art. As the pulley 68 rotates, its first face 84 (see FIG. 9*a*) contacts the lug 88 of the throttle control plate 46 to couple the pulley 68 and plate 46 together. Further rotation of the pulley 68 rotates the throttle control plate 46 in the clockwise direction. The throttle linkage rod 44 communicates this rotation to the throttle control lever 42 such that the throttle control lever 42 follows the rotational movement of the throttle control plate 46. The throttle valves, which are coupled to the throttle control lever 42 in a known manner, open by a corresponding degree as the throttle control plate 46 rotates.

Figure 9B:
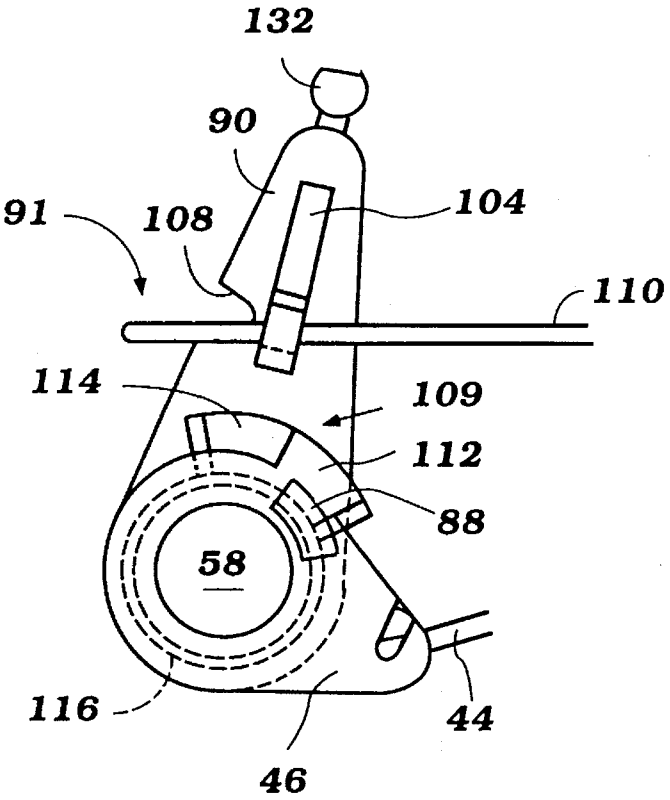
FIG. 9*b* is a side view of the timing control lever of FIG. 3*b* illustrated in the part throttle position.
Figure 9A:
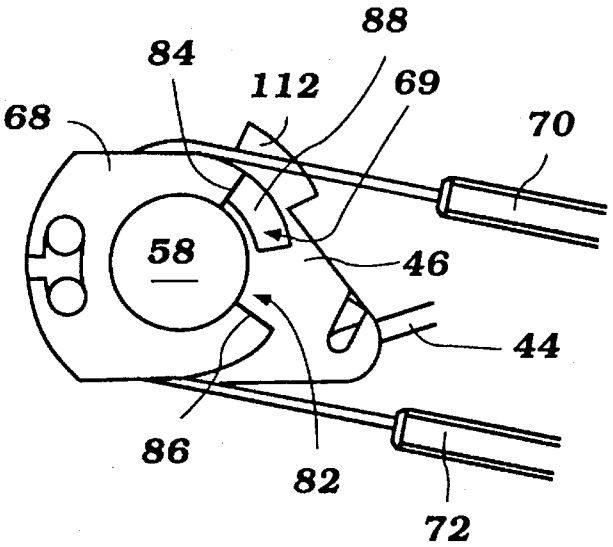
FIG. 9*a* is a side view of the throttle control mechanism of FIG. 3*a* illustrated in the part throttle position.

As seen in FIGS. 7 and 9*b*, the interengagement between the corresponding lugs 112, 114 of the timing control lever 90 and the throttle control plate 46, which is maintained by the spring 116, causes the timing control lever 90 to rotate in the clockwise direction with the throttle control plate 46. The timing control lever 90 thus rotates clockwise in the illustrated embodiment as a result of the corresponding movement of the throttle control plate 46.

The movement of the timing control lever 90 rotates the timing table 122 and pulser coil to further advance the timing. The timing will continue to advance upon opening of the throttle valves (i.e., upon further clockwise rotation of the throttle control plate 46) until the timing control lever 90 contacts the timing adjust screw 90, as illustrated in FIG. 7. The engine spark timing thereafter will remain constant with continued opening of the throttle valves. The general position of the timing table 122 when the timing control lever 90 contacts the timing adjust stop is illustrated in phantom lines in FIG. 2 and is referenced by the reference letter C.

With reference back to FIG. 7, operation of the throttle control mechanism 40 via the manual throttle operator 66 does not affect the choke control mechanism 16. The throttle control plate 46 and the timing control lever 90 rotate about the pivot shaft 58 without moving the choke linkage rod 110. As a result of the lost motion connection 91 between the timing control lever 90 and the choke linkage rod 110, the throttle control mechanism 40 does not operate the choke valves.

Figure 10:
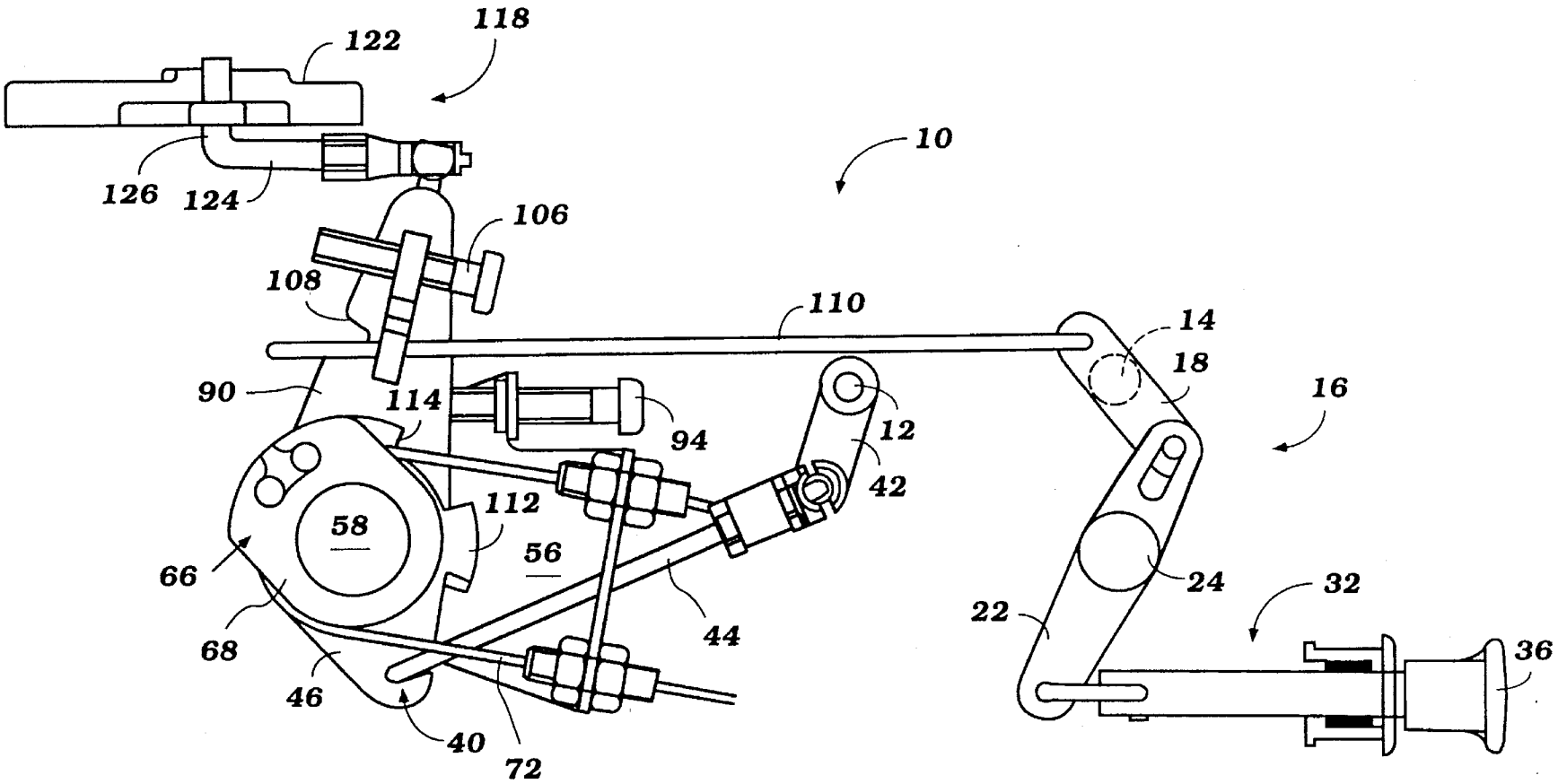
FIG. 10 is a side view of the control mechanism of FIG. 1 illustrated in a full throttle position.
Figure 11B:
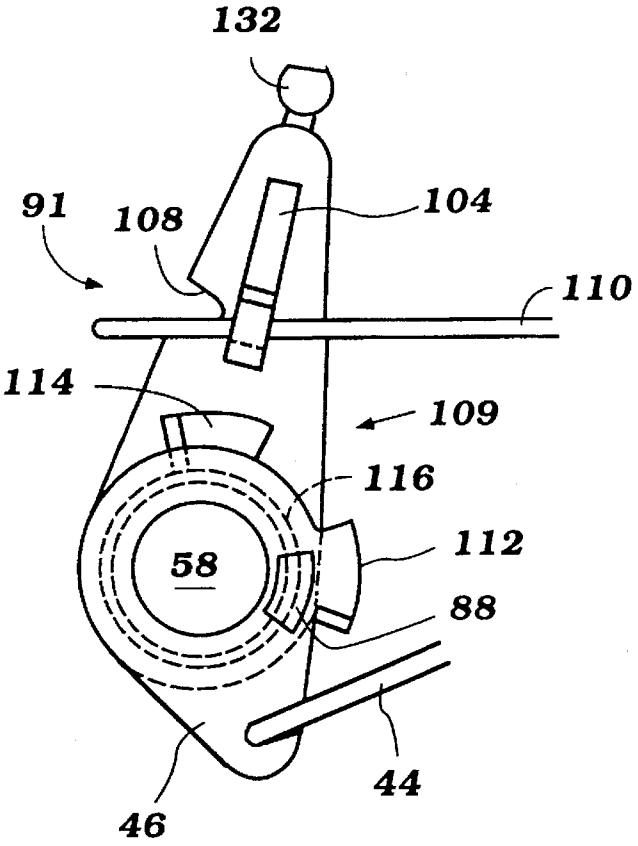
FIG. 11*b* is a side view of the timing control lever of FIG. 3*b* illustrated in a full throttle position.
Figure 11A:
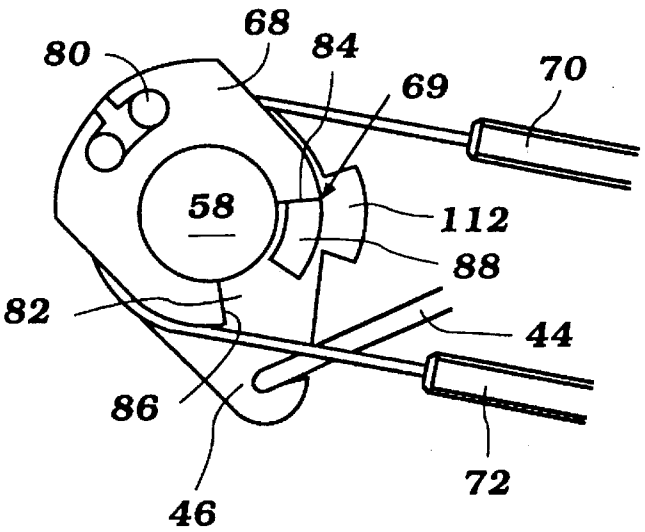
FIG. 11*a* is a side view of the throttle control mechanism of FIG. 3*a* illustrated in the full throttle position.

FIGS. 10 and 11 illustrate the control mechanism 10 in a full throttle position (i.e., a wide open position). To fully open the throttle valves, the user continues to actuate the manual throttle operator 66 to rotate the throttle valves until the throttle valves are wide open. In the illustrated embodiment, the manual throttle operator 66, via the bowden wire cables 70, 72, rotates the pulley 68 further from the position illustrated in FIG. 7 in the clockwise direction. As best understood from FIG. 11*a*, the engagement between the pulley first face 84 and the lug 88 of the throttle control plate 46 causes the throttle control plate 46 to rotate with the pulley 68. The throttle linkage rod 44 communicates this rotation to the throttle control lever 42 such that the throttle control lever 42 follows the rotational movement of the throttle control plate 46. The throttle valves, which are coupled to the throttle control lever 42 in a known manner, open by a corresponding degree as the throttle control lever 42 rotates.

As seen in FIG. 10, the timing adjust screw 94 limits the degree of rotation of the timing control lever 90 about the pivot shaft 58. Once the timing control lever 90 contacts the timing adjust stop 94, the timing control lever 90 does not continue to follow the continued rotation of the throttle control plate 46 toward the full throttle position. As seen in FIG. 11*b*, the corresponding lugs 112, 114 between the timing control lever 90 and the throttle control plate 46 separate as the throttle plate 46 moves relative to the timing control lever 90. This separation winds the spring 116 which further biases the throttle plate 46 toward the idle position (i.e., biases the throttle plate lug 112 toward the timing lever lug 114).

When backing off the full throttle position, the throttle operator 66 rotates the pulley 68 in an opposite direction (i.e., in the counter-clockwise direction in the illustrated embodiment). The biasing force produced by the torsion spring 116 between the throttle plate 46 and the timing control lever 90 causes the timing control plate 46 to follow the movement of the pulley 68 in this direction. That is, the torsion spring 116 biases the throttle plate second lug 88 against the first face 84 of the pulley 68. The first lug 112 of the throttle plate 46 also moves toward the lug 114 of the timing control lever 90 until the corresponding lugs 112, 114 engage. At this point, the throttle control plate 46 and the timing control lever 90 move together toward the idle position. Movement of the timing control lever 90 of course continuously retards the spark timing of the engine as the throttle valves are closed from a part throttle position.

From part throttle to idle, the torsion spring 96 between the support plate 56 and the timing control lever 90 causes the throttle control plate 46 and timing control lever 90 to follow the movement of the pulley 68. At the idle position, the adjust screw 106 carried by the timing control lever 90 contacts the idle stop 108 to prevent further rotation of the timing control lever 90. The interengagement between the corresponding lugs 112, 114 between the timing control lever 90 and the throttle control plate 46 also prevents the throttle control plate 46 from rotating beyond the idle position established by the idle adjust screw 106.

The choke operator 32 when depressed, as illustrated in FIGS. 1, 7, and 10, does not interfere with the movement of the throttle control plate 46 and the timing control lever 90 as they move from the full throttle position to the idle position. As the timing control lever 90 moves into the idle position, the hook end of the choke linkage rod 110 slides into the lever notch 108. If the choke operator 32 remains unactuated, the timing control lever 90 can move between the idle and part throttle positions without affecting the linkage red 110.

The present control mechanism 10 thus provides a means for allowing both the throttle operator 66 and the choke operator 32 to actuate the throttle control mechanism 40 and the timing advance mechanism 118 without affecting the other operator. The throttle operator 66 actuates the throttle valves through the throttle control mechanism 40 and actuates the timing advance mechanism 118 by the lever 90 coupled to the throttle control mechanism 40. Operation of the throttle operator 66 does not affect the choke control mechanism 16 or the choke operator 32. Similarly, the choke operator 32 actuates the throttle control mechanism 40 and timing advance mechanism 118 when closing the choke valves. The throttle valves thus slightly open and the spark timing advances when starting the engine with the choke valves closed. The choke operator 32, however, does not move or otherwise affect the throttle operator 66 or the linkage between the throttle operator 66 and the throttle control mechanism 40.

The present control mechanism 10 also provides a means for the engine spark timing to be advanced as the throttle valves initially open and then to remain constant as the throttle valves open from part throttle to full throttle. It is contemplated, however, that the present control mechanism 10 could be configured such that the timing advance is retarded from a peak advance as the throttle valves approach a wide open position, as known in the art.

Although this invention has been described in terms of a certain preferred embodiment, other embodiments apparent to those of ordinary skill in the art are also within the scope of this invention. For instance, it should be understood that the present control mechanism can be used with either manual or automated operates or a combination of manual and automated operators. Accordingly, the scope of the invention is intended to be defined only by the claims which follow.

What is claimed is:

1. A control mechanism of an engine for controlling the operation of a choke valve and a throttle valve of at least one charge former, said control mechanism comprising a throttle control mechanism coupled to the throttle valve and operated by a throttle operator, and a choke control mechanism coupled to the choke valve and operated by a choke operator, said choke operator also being coupled to said throttle control mechanism in a manner opening the throttle valve when closing the choke valve without affecting said throttle operator.

2. A control mechanism as in claim 1, wherein a lost motion connection couples said throttle operator to said throttle control mechanism.

3. A control mechanism as in claim 2, wherein said throttle operator comprises a pulley operated by at least one wire cable and said throttle control mechanism comprises a throttle control plate coupled to at least one throttle valve, said pulley and said throttle control plate lying adjacent to each other and supported for relative movement.

4. A control mechanism as in claim 3, wherein said lost motion connection couples said pulley to said throttle control plate.

5. A control mechanism as in claim 4, wherein said lost motion connection comprises a lug which extends from said throttle control plate into a relief formed in said pulley, said relief being larger than said lug to permit movement of said lug within said relief.

6. A control mechanism as in claim 5, wherein said relief comprising an abutment surface which contacts said lug when said pulley rotates in one direction.

7. A control mechanism as in claim 6, wherein said lug is biased against said abutment surface such that when operated by said throttle operator said pulley and said throttle control plate rotate together.

8. A control mechanism as in claim 4, wherein said throttle control plate also is coupled to said choke operator, said lost motion connection between said throttle control plate and said pulley being configured to permit said choke operator to actuate said throttle control plate without actuating said pulley.

9. A control mechanism as in claim 8, wherein at least one lost motion connection couples said choke control mechanism to said throttle control plate such that said throttle operator does not operate said choke control mechanism.

10. A control mechanism as in claim 1 additionally comprising a timing advance mechanism operated by both said choke operator and said throttle operator, said timing advance mechanism coupled to said throttle operator in a manner such that said choke operator actuates said timing advance mechanism without affecting said throttle operator.

11. A control mechanism as in claim 10, wherein said timing advance mechanism is coupled to said choke operator in a manner such that said throttle operator actuates said timing advance mechanism without affecting said choke operator.

12. A control mechanism as in claim 11, wherein at least one lost motion connection couples said timing advance mechanism to said choke operator.

13. A control mechanism as in claim 10, wherein at least one lost motion connection couples said timing advance mechanism to said throttle operator.

14. A control mechanism as in claim 13, wherein said timing advance mechanism comprises a timing control lever positioned adjacent to a throttle control plate of said throttle control mechanism and supported for relative movement, said lost motion connection coupling said timing control lever to said throttle control plate.

15. A control mechanism as in claim 14, wherein said lost motion connection comprises a first lug on said throttle control plate and a second cooperating lug on said timing control lever, said first and second lug biased to engage one each other but configured to allow movement relative to each other.

16. A control mechanism of an engine for controlling the operation of at least one valve of at least one charge former, said control mechanism comprising a valve control mechanism coupled to the valve, said valve control mechanism being operated by both a first operator and a second operator, a first lost motion connection coupling said first operator to said valve control mechanism such that said second operator operates said valve control mechanism without affecting said first operator, and a second lost motion connection coupling said second operator to said valve control mechanism such that said first operator operates said valve control mechanism without affecting said second operator.

17. A control mechanism as in claim 16, wherein said valve control mechanism controls at least one throttle valve of the charge former.

18. A control mechanism as in claim 17, wherein said first operator directly operates at least one choke valve of the charge former.

19. A control mechanism as in claim 16 additionally comprising a timing advance mechanism coupled to said valve control mechanism between said first and second lost motion connections.

20. A control mechanism as in claim 19, wherein a third lost motion connections couples said timing advance mechanism to said valve control mechanism.

21. A control mechanism of an engine for controlling the operation of a choke valve and a throttle valve of at least one charge former, said control mechanism comprising a choke control mechanism which opens and closes the choke valve, a choke operator actuating said choke control mechanism, a throttle control mechanism having a throttle control plate coupled to the throttle valve to open and close the throttle valve, a throttle operator actuating said throttle control mechanism to move said throttle control mechanism between an idle position and a wide open position, said throttle control mechanism being biased toward said idle position, and a rod extending between said choke control mechanism and said throttle control mechanism, said rod unilaterally transmitting movement of said choke operator to said throttle control mechanism, said throttle control plate and said throttle operator having engaging structures which engage when said throttle operator is moved such that said throttle control mechanism responds to movement of said throttle operator and disengages when said throttle control mechanism is moved by said rod so that said throttle operator is not affected by movement actuated by said rod.

22. A control mechanism as in claim 21, wherein said throttle control mechanism includes a timing control lever which operates a timing advance mechanism, said rod communicating said movement of said choke control mechanism to said throttle control mechanism through said timing control lever.

23. A control mechanism as in claim 22, wherein said timing control lever and said throttle control plate have engaging structures which are biased together, but are separable when said throttle operator moves said throttle control plate toward said wide open position.

* * * * *